United States Patent [19]

Pedersen

[11] 4,296,829

[45] Oct. 27, 1981

[54] HOOK-SHAPED PART OF A BEHIND-THE-EAR HEARING AID

[75] Inventor: Jorgen R. Pedersen, Gentofte, Denmark

[73] Assignee: Danavox A/S, Copenhagen, Denmark

[21] Appl. No.: 103,651

[22] Filed: Dec. 14, 1979

[30] Foreign Application Priority Data

Dec. 15, 1978 [DK] Denmark ..... 5662/78

[51] Int. Cl.[3] ..... H04R 25/02

[52] U.S. Cl. ..... 181/129; 179/107 H

[58] Field of Search ..... 181/129, 130, 135, 137; 179/107 R, 107 H, 107 BC; D24/35

[56] References Cited

U.S. PATENT DOCUMENTS 3,259,205 7/1966 Dubow ..... 181/129

FOREIGN PATENT DOCUMENTS 973479 10/1964 United Kingdom ..... 179/107 H

*Primary Examiner*—L. T. Hix
*Assistant Examiner*—Thomas H. Tarcza
*Attorney, Agent, or Firm*—Nolte and Nolte

[57] ABSTRACT

A hook shaped part (2) for a behind the ear hearing aid. The hook shaped part is hollow and at one end (5) formed to be connected to an acoustic output from the upper front end of the hearing aid case (1) and serving to transmit sound from the hearing aid in the direction of the ear, normally through a tube (3) and an ear plug (4), and also serving to support the hearing aid upon the outer ear. In the hook shaped part there is, at the end (8) furthest from the hearing aid included an acoustic filter (9). The hook shaped part (2) has, in the direction away from the hearing aid a channel (6) of increasing cross sectional area. Through the form of the channel (6) is obtained a suppression of resonant phenomena in the tube (3) and the frequency response is made independent of the length of this tube.

6 Claims, 7 Drawing Figures

HOOK-SHAPED PART OF A BEHIND-THE-EAR HEARING AID

Figure 1:
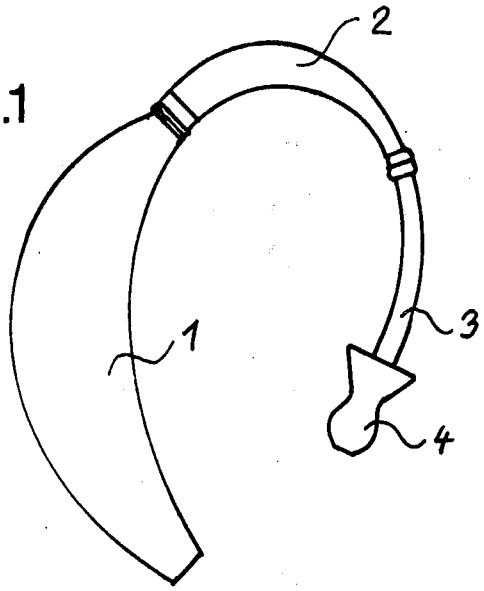

The invention concerns a hook shaped part of a behind-the-ear hearing aid, said hook shaped part being hollow and at the one end formed to connect with the acoustic output from the top front end of the hearing aid case and serving to transmit sound from the hearing aid to the ear, usually through a tube and an ear plug, and in which hook shaped part there is, at the end furthest from the hearing aid, incorporated an acoustic filter.

Experience has shown that, with hearing aids of the relevant type, there often occur changes in the frequency response when the hearing aid is adapted to individual use and that these changes cannot be prevented by the manufacturer by adjustment of the hearing aid amplifier as the changes are dependent upon the length of the tube between the ear plug and the hook shaped part of the hearing aid and this tube is cut to the required length by the individual user according to his anatomy.

It is the purpose of the invention to provide a hook shaped part of the aforementioned type by which a better frequency response is obtained. This is achieved according to claim 1 by the hook shaped part being so constructed that it has, in the direction away from the hearing aid, an increasing cross sectional area of the contained opening. The area of the effective opening may, with advantage, be made progressively increasing.

It can be shown that changes in frequency response are caused by resonant phenomena in the tube and that the frequencies at which these phenomena occur are dependent upon the length of the tube. These resonant phenomena which distort the, natural for the ear, frequency response aimed at by the manufacturer can be suppressed, and the natural frequency response restored, by shaping the sound channel within the hook shaped part in accordance with the invention. At the same time it has been found that a tendency toward reduction in the stability of the hearing aid caused by the resonant phenomena provoking positive feedback through leaks at the ear plug is reduced.

The hook shaped part may be formed as described in claim 2. The hook shaped part may, to advantage, be formed by casting or moulding and the internal channel formed with the aid of a, generally, arc-shaped core which is withdrawn after casting by a circular motion. As, at the end nearest the hearing aid, there is generally incorporated in the casting an enlargment to facilitate the attachment of the hook shaped part over a cylindrical piece projecting from the hearing aid case, it is most practical to withdraw the core from this end and thus the channel within the hook shaped part cannot, under these circumstances, be formed with the required increasing cross section in the direction away from the hearing aid case, but, at the most, a constant area. With the aid of the part described in claim 2 however the required increasing cross section is achieved. That which is described in claim 2 is a simple and inexpensive measure. The channel in the hook shaped part is, generally, circular in cross section and the part inserted therein may to advantage have a rectangular cross section of decreasing width and/or breadth in the direction away from the hearing aid case.

The hook shaped part may, according to the invention, be formed as described in claim 3. The relevant slots are simple to manufacture by moulding. The slots are generally axially arranged but may also have a sloping direction.

A further version is possible with a single or multi-start thread to serve as the slots.

With the acoustic filter a further suppression of resonant phenomena in the tube is achieved and thus a further improvement in frequency response.

Figure 5:
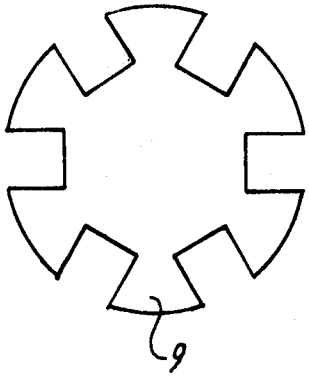
Figure 3:
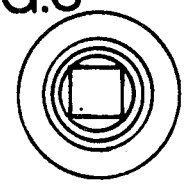
Figure 2:
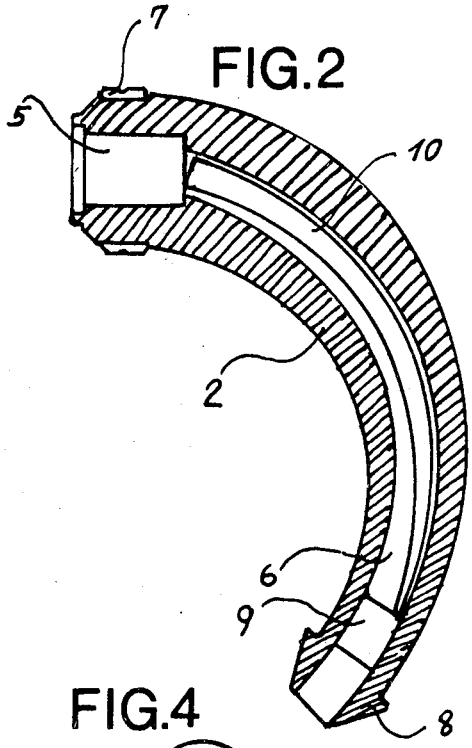
Figure 4:
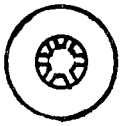

The drawing shows:

FIG. 1 a behind the ear hearing aid with a hook shaped part according to the invention, FIG. 2 a section through the hook shaped part on a larger scale, FIG. 3 the one end of the hook shaped part also on a larger scale, FIG. 4 the other end of the hook shaped part also on a larger scale, FIG. 5 a plug positioned in the hook shaped part and acting as an acoustic filter. Seen in axial direction on a larger scale, FIG. 6 an insert to the hook shaped part seen in axial direction with regard to the hook shaped part, and FIG. 7 the insert seen at right angle to the above.

Figure 7:
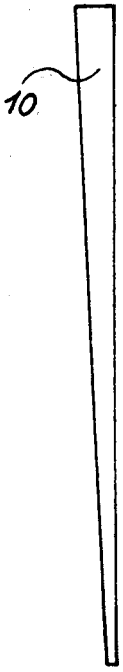
Figure 6:
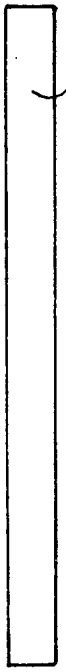

The behind the ear hearing aid shown in the drawing has a case 1, a hook shaped part 2, a tube 3, and an earplug 4. In the case 1 are contained a microphone, an amplifier, a battery and a transducer. The transducer is connected to a threaded metal tube which projects from the top front end of the case. The hook shaped part 2 has at one end a hollow 5 with a diameter suitable to attachment to the above mentioned threaded tube. In continuation of the hollow 5 there is a penetrating channel 6 with a generally constant diameter. External to the hollow 5 is placed a metal ring 7. The hook shaped part consists of a suitable relatively hard plastic material. The hook shaped part 2 has, in the direction from the ring 7, progressively decreasing external diameter to a projection 8 at the opposite end. The projection 8 serves to removably attach one end of the tube 3. In the hook shaped part 2 at or near the projection 8 and within the channel 6 is inserted a suitable plug 9 which has axial slots. In the residual length of the channel 6 is inserted a wedge-shaped piece 10 as shown in FIGS. 6 and 7. This is moulded from flexible plastic so that it may be inserted and bent to the position shown in FIG. 2. There is thus achieved within the hook shaped part and in the direction away from the hollow 5 a channel of progressively increasing area. The axial slots in the plug 9 form channels for sound so that the plug forms an acoustic filter to achieve the required frequency response. The wedge 10 has the effect that, because of the progressively increasing opening, a horn-like effect is achieved which also helps to achieve the desired frequency response.

The shown and described construction should be understood as an example as the channel 6 may have a cross section other than circular, e.g., elliptical or generally rectangular. There may be two or more acoustic filters.

What we claim is:

1. An improved hook shaped part for a behind-the-ear hearing aid, said hook shaped part being hollow and at one end formed to be connected to an acoustic output from the upper front end of the hearing aid case and serving to transmit sound from the hearing aid in the direction of the ear, normally through a tube and an ear plug, and also serving to support the hearing aid upon the outer ear, the improvement comprising an acoustic filter arranged in the hook shaped part at the end furthest from the hearing aid and the hook shaped part having a channel of progressively increasing cross-sectional area in the direction away from the hearing aid.

2. A hook shaped part according to claim 1 wherein the channel within the hook shaped part has a constant cross sectional area and further comprising an element introduced within the channel which has, in the direction from the hearing aid, a decreasing cross-sectional area.

3. A hook shaped part according to claims 1 or 2 in which the acoustic filter consists of a plug inserted within the hook shaped part characterized by the plug having one or more external longitudinal slots.

4. A method for improving the response of a hearing aid of the type having a hollow hook-shaped part for transmitting the sound from the hearing aid to the ear, the method comprising the steps of:

forming the internal channel of the hollow hook-shaped part having a progressively increasing cross-sectional area; and inserting an acoustic filter into the internal channel of the hook shaped part at the end thereof furthest from the hearing aid.

5. The method of claim 4 wherein the step of forming the internal channel comprises the steps of:

forming the internal channel of the hollow hook-shaped part with a constant cross-sectional area; and inserting into the internal channel an element having a decreasing cross-sectional area in the direction away from the hearing aid, thereby forming the internal channel with a progressively increasing cross-sectional area.

6. The method of claim 4 comprising the further steps of:

forming the acoustic filter as a plug; and forming external longitudinal slots in the plug.

* * * * *